US010332706B2

(12) United States Patent
Mangold et al.

(10) Patent No.: US 10,332,706 B2
(45) Date of Patent: Jun. 25, 2019

(54) BIMETAL CONTROLLER

(75) Inventors: Elmar Mangold, Unterschneidheim Zoebingen (DE); Andreas J. Beckmann, Pforzheim (DE)

(73) Assignee: STEGO-HOLDING GMBH, Schwaebisch Hall (DE)

( * ) Notice: Subject to any disclaimer, the term of this patent is extended or adjusted under 35 U.S.C. 154(b) by 150 days.

(21) Appl. No.: 13/808,629

(22) PCT Filed: Jul. 1, 2011

(86) PCT No.: PCT/EP2011/061087

§ 371 (c)(1),
(2), (4) Date: Jan. 7, 2013

(87) PCT Pub. No.: WO2012/004197

PCT Pub. Date: Jan. 12, 2012

(65) Prior Publication Data

US 2013/0106566 A1 May 2, 2013

(30) Foreign Application Priority Data

Jul. 5, 2010 (DE) ..... 10 2010 017 741

(51) Int. Cl.
*H01H 37/52* (2006.01)
*H01H 37/12* (2006.01)

(52) U.S. Cl.
CPC ..... *H01H 37/52* (2013.01); *H01H 37/521* (2013.01); *H01H 37/12* (2013.01)

(58) Field of Classification Search
CPC ..... H01H 37/12; H01H 37/52; H01H 37/521
USPC ..... 337/379
See application file for complete search history.

(56) References Cited

U.S. PATENT DOCUMENTS

| | | | | |
|---|---|---|---|---|
| 847,981 | A * | 3/1907 | Brown | 337/364 |
| 1,408,168 | A * | 2/1922 | Buck | 337/370 |
| 2,574,192 | A * | 11/1951 | Samuel | 337/372 |
| 2,585,068 | A * | 2/1952 | Wood | 337/96 |

(Continued)

FOREIGN PATENT DOCUMENTS

| | | |
|---|---|---|
| DE | 361876 | 10/1922 |
| DE | 522073 | 3/1931 |

(Continued)

OTHER PUBLICATIONS

EPO Patent Translate, Translation of DE 2406867 A1.*

(Continued)

*Primary Examiner* — Jacob R Crum
(74) *Attorney, Agent, or Firm* — Hassan Abbas Shakir; Shakir Law PLLC

(57) ABSTRACT

A bimetallic controller, having a switching device and at least one bimetal device which is or can be actively connected to the switching device such as to allow the switching device to be switched in a temperature-dependent fashion. The bimetal device includes at least one first bimetal element and at least one curved second bimetal element that are connected to each other in a zone of contact and are designed in said zone of contact such that the coefficient of thermal expansion of the first bimetal element increases from its bottom to the top and the coefficient of thermal expansion of the curved second bimetal element decreases from its bottom to the top, or vice versa.

14 Claims, 3 Drawing Sheets

(56) References Cited

U.S. PATENT DOCUMENTS

| | | | | | |
|---|---|---|---|---|---|
| 3,015,015 | A | * | 12/1961 | Wirma | 219/510 |
| 3,160,010 | A | | 12/1964 | Levinn et al. | |
| 3,227,842 | A | | 1/1966 | Salem | |
| 3,292,070 | A | * | 12/1966 | Hischak | 318/472 |
| 3,441,697 | A | * | 4/1969 | Wingard | H01H 9/36 218/149 |
| 3,833,873 | A | * | 9/1974 | Moksu | H01H 1/504 337/85 |
| 4,270,835 | A | * | 6/1981 | Kordt et al. | 439/94 |
| 4,521,760 | A | | 6/1985 | Carbone et al. | |
| 4,601,531 | A | * | 7/1986 | Wider | 439/793 |
| 4,902,999 | A | | 2/1990 | Ball, Jr. et al. | |

FOREIGN PATENT DOCUMENTS

| | | | | | |
|---|---|---|---|---|---|
| DE | 889782 | | | 9/1953 | |
| DE | 894469 | | | 10/1953 | |
| DE | 1077333 | | | 3/1960 | |
| DE | 002406867 | A1 | * | 8/1975 | H01H 37/52 |
| DE | 2406867 | A1 | * | 8/1975 | H01H 37/52 |
| DE | 202011000283 | | | 4/2011 | |
| EP | 0187232 | | | 7/1986 | |
| FR | 2489616 | | | 3/1982 | |
| JP | 374817 | | | 6/1958 | |
| JP | 5033641 | | | 10/1975 | |
| JP | S62-34739 | U | | 2/1987 | |
| JP | 02113250 | | | 9/1990 | |

OTHER PUBLICATIONS

Schumann, Machine Translation of DE 2406867 A1.*

Japanese Office Action for JP 2013-517311, dated Jan. 28, 2014, English translation attached to original, All together 4 Pages.

International Search Report for PCT/EP2011/061087, English translation attached to original, Both completed by the European Patent Office on Nov. 8, 2011, All together 7 Pages.

Decision of Rejection of Amendment dated Feb. 26, 2018 by the Korean Intellectual Property Office in Korean Patent Application No. 10-2013-7002240, English translation.

* cited by examiner

BIMETAL CONTROLLER

CROSS-REFERENCE TO RELATED APPLICATIONS

This application is the U.S. national phase of PCT Application No. PCT/EP2011/061087 filed on Jul. 1, 2011, now published as WO 2012/004197, which claims priority to German Patent Application No. 10 2010 017 741.5 filed on Jul. 5, 2010, the disclosures of which are incorporated in their entirety by reference herein.

TECHNICAL FIELD

The invention relates to a bimetal controller comprising a switching device and at least one bimetal device, which is or can be actively connected to the switching device in such a way as to allow a temperature-dependent switching of the switching device.

BACKGROUND

Such bimetal controllers are known from the prior art.

A bimetal or thermobimetal is a metal element comprising two layers of different materials which are connected to each other with a material bond or a form fit. The change in shape when there is a change in temperature is characteristic. The change in shape is manifested as a bending of the bimetal. This is caused by the different coefficients of thermal expansion of the metals used. If one metal expands more than the assigned other metal, there is a bending of the combination of metal layers. The two metals are usually connected to each other by rolling, and in particular cold welding, or else by mechanical connecting means, such as for example rivets.

A known application area of such bimetals is that of temperature-dependent switches, the bimetals being used here such that they actuate a switching device when there are changes in temperature and the accompanying bendings occur.

DE 894 469 shows for example such a bimetal controller or switch, in which a bimetal is attached by one end to a base structure and is actively connected by a free end to a switching device. This switching device consists of two switching elements, which can be set in relation to each other by way of a stop plate. When there is a deformation of the bimetal controller, this causes a closing of the contacts of the two switching elements, that is to say a switching operation, by way of which an assigned electrical appliance, etc. can be activated.

DE 889 782 shows a similar bimetal controller, in which the bimetal is likewise attached by one end on a base structure and is actively connected by another, free end to a switching device. Here, too, the switching operation triggered by the bending of the bimetal element at the free end can be set by way of a suitable setting device.

The bimetal controllers known from the prior art usually cannot be set accurately enough with regard to the switching temperature. This is in evidence particularly in the case of very small bimetal controllers.

SUMMARY

The object of the invention is consequently to offer a bimetal controller of the type mentioned at the beginning which ensures a switching behavior that can be accurately set and/or a small hysteresis, in particular also with a small construction.

This object is achieved by a bimetal controller according to patent claim 1.

In particular, this object is achieved by a bimetal controller comprising a switching device and at least one bimetal device, which is or can be actively connected to the switching device in such a way as to allow a temperature-dependent switching of the switching device, the bimetal device having at least one first bimetal element and at least one arcuate, second bimetal element, which are connected to each other at a contact region and are formed at the contact region in such a way that the coefficient of thermal expansion of the first bimetal element decreases from the underside thereof to the upper side and the coefficient of thermal expansion of the arcuate, second bimetal element increases from its underside to the upper side, or vice versa.

Such an arrangement comprising at least two bimetal elements which are connected to each other and are formed such that they have an opposing progression of the coefficients of thermal expansion in the contact region leads to a bimetal device with greater switching movements when there are changing ambient temperatures in comparison with the bimetal devices that are known from the prior art.

Preferably, at least the first bimetal element and at least the arcuate, second bimetal element are constructed from in each case at least two element layers with different coefficients of thermal expansion, the layer structure of the first bimetal element progressing oppositely to the layer structure of the arcuate, second bimetal element with respect to the coefficients of thermal expansion.

An essential point is that the bimetal device of the bimetal controller according to the invention consists of at least two bimetal elements, to be specific at least one first bimetal element and at least one second, arcuate bimetal element, both bimetal elements being multilayer elements and the layer elements used for each bimetal element having such different coefficients of thermal expansion that the respective bimetal element deforms in dependence on the ambient temperature. According to the invention, the two bimetal elements are in this case connected to each other at a contact region such that the layer structure of the first bimetal element progresses oppositely to the layer structure of the arcuate, second bimetal element with respect to the coefficients of thermal expansion.

Within the scope of the invention, this "opposed arrangement" of the layer structure is understood as meaning such an arrangement in which the layer structure of the first bimetal element, considered from the layer with the lower coefficient of thermal expansion to the layer with the higher coefficient of thermal expansion, progresses oppositely to the layer structure of the second, arcuate bimetal element with respect to the coefficients of thermal expansion. Thus, for example, a bimetal element comprising a lower layer with a high coefficient of thermal expansion and an upper layer with a lower coefficient of thermal expansion, or quite generally a bimetal element with a coefficient of thermal expansion decreasing from the underside to the upper side, and a bimetal element comprising a lower layer with a low coefficient of thermal expansion and an upper layer with a higher coefficient of thermal expansion, or the coefficient of thermal expansion increasing from the underside to the upper side, therefore meet each other in the contact region. To this extent, bimetal devices in which the first bimetal element has a different layer structure, inter alia with respect to the number of layers or the materials used or the material thicknesses, than the second, arcuate bimetal element are therefore also within the scope of the invention, as long as an "opposed layer structure" is provided, in particular in the contact region.

"Arcuate" is understood within the scope of this invention as meaning any kind of deviation from a straight line or a principal axis of extent of the bimetal element, and in particular a shape, particularly a shape of an arc of a circle, in which a partial region of the bimetal element runs in a direction offset by at least 90 degrees in relation to the other partial region of the first and/or second bimetal element.

The way in which, according to the invention, the first bimetal element is arranged and formed in relation to the second, arcuate bimetal element provides a bimetal device in which the individual movements of the two bimetal elements connected to each other are added together particularly effectively, which leads to a particularly effective switching movement. The result is a bimetal controller in which great movements occur at the bimetal device even when there are small changes in temperature, so that, inter alia even when there are small changes in temperature, switching operations can be performed. The resultant bimetal controller is consequently very much more sensitive in comparison with controllers from the prior art.

Preferably, the bimetal device comprises a plurality of combinations of first bimetal elements and arcuate, second bimetal elements arranged in series. In this way, the great switching movements can easily be added together. The bimetal device is in this case preferably formed such that the arrangement of first bimetal elements and arcuate, second bimetal elements alternates, the opposed arrangement of the layer structures of the respective bimetal elements also again being respectively in evidence here. It is also possible to form the bimetal device in such a way that a combination of the first bimetal element and the arcuate, second bimetal element is connected to a further combination of a first bimetal element and an arcuate, second bimetal element by way of a further intermediate element and preferably a non-bimetallic intermediate element. It is also possible to form the bimetal device in a meandering manner by corresponding arrangement of the first and second bimetal elements, in particular in order in this way to compensate for movements substantially perpendicularly to the main direction of movement (that is to say the direction of movement that brings about a switching operation). Moreover, it is conceivable also to arrange said intermediate elements and preferably non-bimetallic intermediate elements between at least one first bimetal element and an arcuate, second bimetal element.

Preferably, the first bimetal element and/or the arcuate, second bimetal element is/are formed as a bimetal strip/bimetal strips. Being formed by a bimetal strip/bimetal strips ensures a switching movement of the bimetal device in a defined direction of movement.

Preferably, the contact region is arranged at the one, distal end of the first bimetal element and a proximal end of the arcuate, second bimetal element. In this way, a particularly effective addition of the respective bimetal element movements is obtained when there are changes in temperature.

Preferably, the arcuate, second bimetal element describes a half arc to almost a full arc and in particular a three-quarter arc, in particular a half arc of a circle to almost a full arc of a circle and in particular a three-quarter arc of a circle. In this way, the element movements of the first bimetal element and the arcuate, second bimetal element when there is a change in temperature add together particularly effectively to form a common switching movement, the bimetal device at the same time being given a very compact structure.

Preferably, the arcuate, second bimetal element has at its distal end a switching region, in particular a substantially linearly formed switching region, which is or can be actively connected to the switching device. By the movement of the first bimetal element, coupled with the movement of the second, arcuate bimetal element, a switching movement is transmitted very easily to the switching device by way of the switching region.

Preferably, the principal axis of extent of the switching region and the tangent adjoining thereto of the arcuate, second bimetal element include an angle of <180 degrees, in particular an angle of ≤90 degrees. In this way, a very compact component is obtained, along with a very effective combination of the individual bimetal movements when there are changes in temperature.

Preferably, the switching region of the arcuate, second bimetal element is arranged axially parallel to the principal axis of extent of the first bimetal element when there is a defined normal temperature T.sub.0. In particular in the case of a second bimetal element substantially in the form of a full arc or a full circle, a bimetal element with very great switching travel is thus obtained, with at the same time a compact construction of the controller.

Preferably, the bimetal device is mounted with a proximal end of the first bimetal element substantially restrained in relation to the switching device. On the basis of this point of restraint, a bimetal device with very great switching travel that can also be arranged in a very confined space is obtained.

Preferably, in the case of the arcuate, second bimetal element, the element layer with the higher coefficient of thermal expansion is arranged in the region of the inner arc. In this way, a bimetal device which expands very greatly when there is an increase in temperature and acts on a switching device arranged in the area around the outside of the bimetal device is obtained. In the case of a switching device which is arranged substantially within the bimetal device, in the case of which a contraction of the bimetal device is therefore necessary to activate the switching movement, the element layer with the higher coefficient of thermal expansion is preferably arranged in the region of the outer arc of the second bimetal element.

The present invention also relates to an apparatus for the electrically conducting connection of at least one conducting element to aforementioned bimetal controllers or to a contact element of such a switching device that is mounted in a housing, a clamping device which has the following being provided: a clamping bolt and a clamping bolt receptacle, which together define a clamping space into which the conducting element can be introduced from the outer side of the housing and into which the contact element protrudes from the inner side of the housing, the clamping bolt being held in its axial direction in the housing and lying with a clamping continuation against the contact element in an unconstrained manner, and a counter bearing region of the clamping bolt receptacle being able to be moved toward the clamping continuation and the contact element lying on it and able to be fixed at least in one clamping position such that the conducting element and the contact element are fixed with respect to each other in an electrically conducting manner, without a flexural loading being introduced into the contact element.

The advantage of such an apparatus or of a bimetal controller formed in this way is that the connection of a conducting element to the bimetal controller is possible without involving any introduction of heat, for example by a welding or soldering operation. According to the invention, such introduction of heat in the case of bimetal controllers from the prior art leads to a weakening of the spring elements of the switching device that are usually provided. The use of the apparatus according to the invention avoids this problem. In particular in conjunction with the previously discussed bimetal device, a bimetal controller with a switching behavior that is very accurate, and in particular can be accurately set, is thus obtained.

Further embodiments of the invention are provided by the subclaims.

BRIEF DESCRIPTION OF THE DRAWINGS

The invention is described below on the basis of exemplary embodiments, which are explained in more detail by the accompanying drawings, in which.

DETAILED DESCRIPTION

The same reference signs are used hereafter for components that are the same and components that act in the same way, superscripts sometimes being used for the purpose of distinction.

Figure 1:
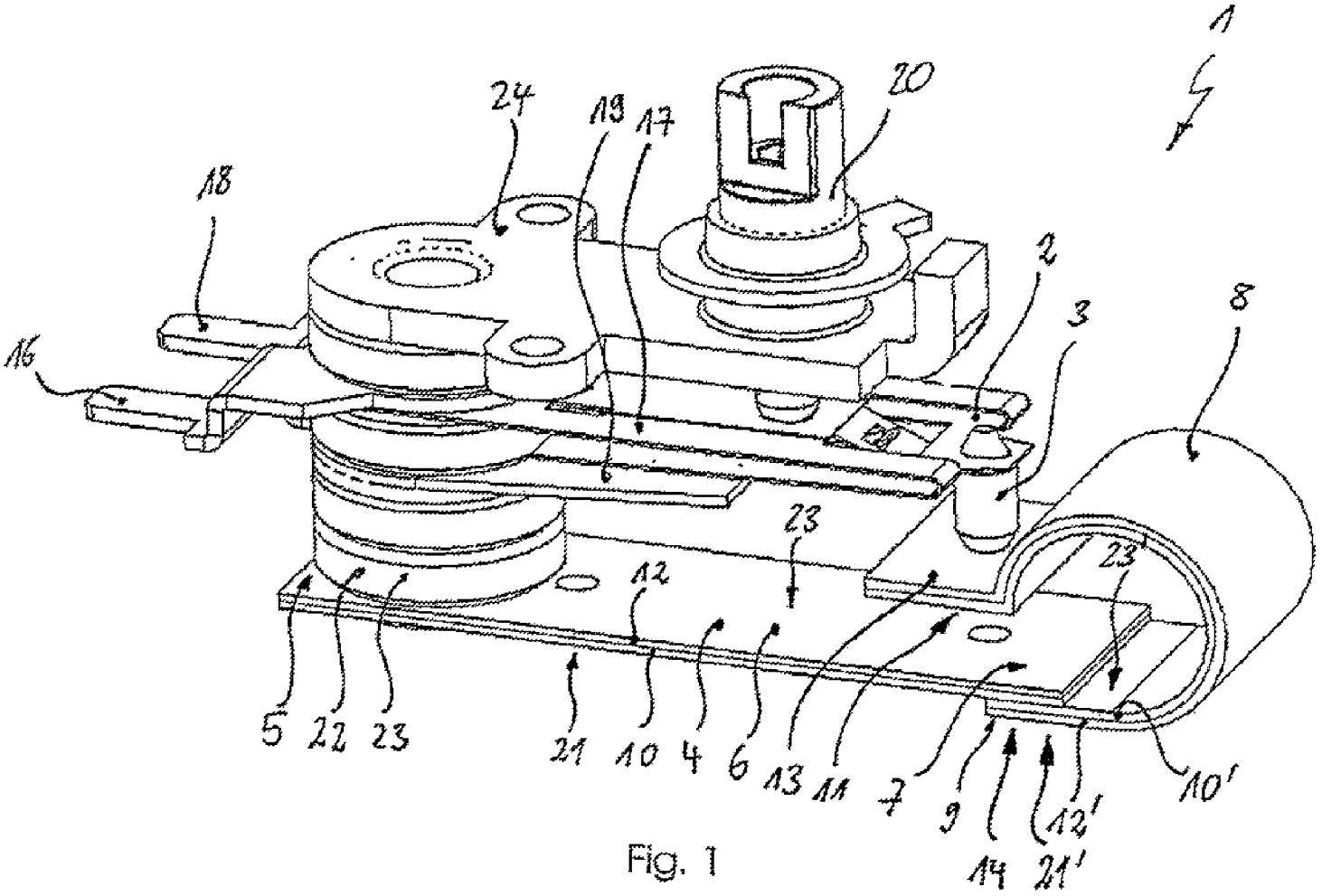
FIG. 1 shows an isometric representation of an embodiment of the bimetal controller.
Figure 2:
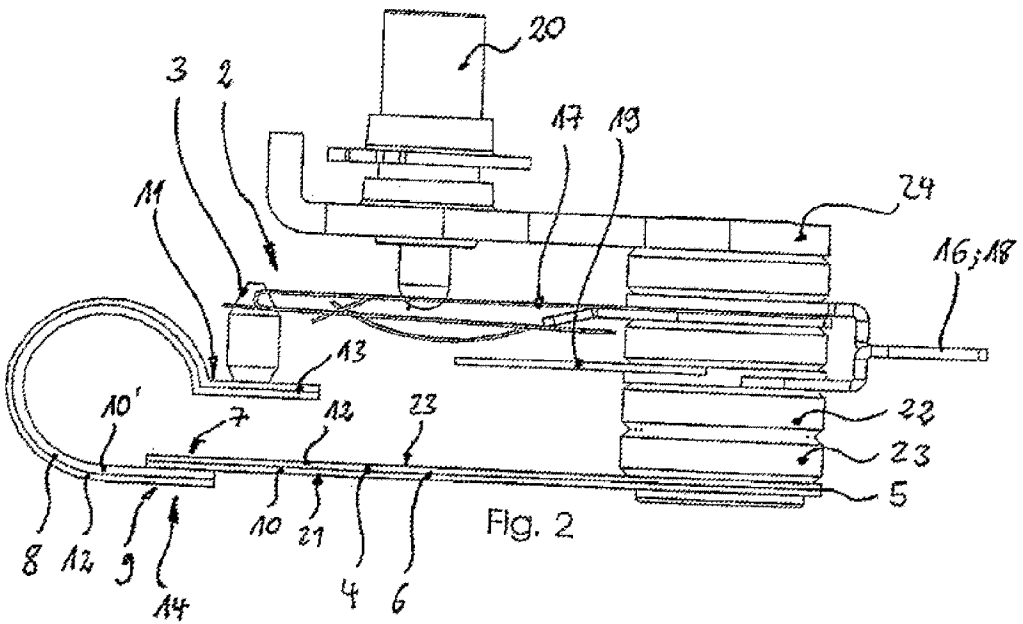
FIG. 2 shows a side view of the embodiment of the bimetal controller from FIG. 1.
Figure 3:
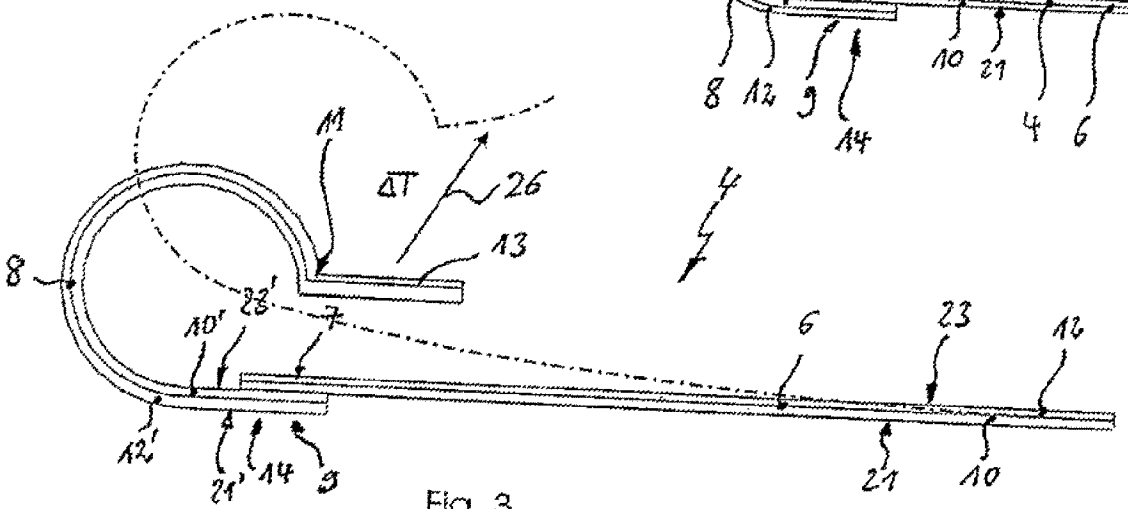
FIG. 3 shows the view of a detail of a bimetal device of the embodiment of the bimetal controller from FIG. 1.

FIG. 1 shows an isometric representation of an embodiment of the bimetal controller according to the invention, FIG. 2 shows a side view of this embodiment and FIG. 3 shows a representation of a detail of a bimetal device 4, such as that used in this bimetal controller 1.

In the case of this embodiment, the bimetal device 4 has two bimetal elements 6, 8, to be specific a first bimetal element 6 and an arcuate, second bimetal element 8. The arcuate, second bimetal element is configured here at least partially in the form of a ¾ circle. These two bimetal elements 6, 8 are connected to each other at a contact region 14, in particular here the first bimetal element 6 is arranged with its distal end 7 on the proximal end 9 of the arcuate, second bimetal element 8.

The bimetal device 4 is actively connected by way of a switching element 3 to a switching device 2, which establishes an electrical connection between two contact elements 16, 18, that is to say allows a switching operation. An adjustment of the switching operation can be made by way of a setting element 20, in that two switching contacts 17, 19 assigned to the contact elements 16, 18 are positioned in relation to each other. Depending on how this positioning is performed, the switching device 2 triggers the switching operation when there are small or greater movements of the bimetal device 4.

The bimetal device 4 is restrained in a substantially flexurally rigid manner by a proximal end 5 of the first bimetal element 6 on a bearing block 22. This bearing block, which consists of a number of isolating individual elements 23, carries not only the bimetal device 4 but also the contact elements 16 and 18 and a retaining plate 24, which allows the bimetal controller 1 to be fastened in a housing 40 (see FIG. 7) and additionally carries the setting elements 20.

The arcuate, second bimetal element 8 has at its distal end 11 a switching region 13, by way of which it is actively connected to the switching device 2 by the switching element 3. When there is a change in temperature, the switching region 13 moves on account of the resulting movement of the two bimetal elements 6, 8 toward the switching device 2, the switching element 3 triggering the switching operation when there is a specific movement.

The structure of the switching device 2 can be seen in detail in FIG. 2 in particular. It comprises the two contact elements 16 and 18, which can be brought into electrically conducting connection with each other via the assigned contact elements 17 and 19 by an activation taking place by way of the switching element 3. The contact element 17 is formed here as a spring element, and in particular as a beryllium-sprung spring element, so that the electrical conducting connection is opened again when there is a "retraction" of the switching element 3.

In FIGS. 1 and 2, and in particular in FIG. 3, the different layer structures of the two bimetal elements 6, 8 of the bimetal device 4 can be seen. The first bimetal element 6 consists of two element layers 10, 12, element layer 10 with the greater coefficient of thermal expansion .alpha..sub..DELTA.T10 being arranged on the underside 21, as represented in the plane of the drawing, and the element layer 12 with the lower coefficient of thermal expansion .alpha..sub..DELTA.T12 being arranged on the upper side 23.

The layer structure of the arcuate, second bimetal element 8 is formed oppositely thereto. This bimetal element 8 also consists of two element layers 10, 12, the element layer 10 with the higher coefficient of thermal expansion .alpha..sub..DELTA.T10 being arranged on the upper side 23, as represented in the plane of the drawing, and the element layer 12 with the lower coefficient of thermal expansion .alpha..sub..DELTA.T12 being arranged on the underside 21 in the contact region 14.

The result of such an opposed arrangement of the two layer structures of the two bimetal elements 6, 8 is a very much stronger deflection (represented here in FIG. 3 by the arrow 26), which in the case of the bimetal controller 1 represented here leads to a very much more accurate adjustability and more accurate switchability.

In FIG. 3, the movement of the bimetal device 4 or of the two bimetal elements 6, 8 when there is a specific change in temperature .DELTA.T is represented diagrammatically, the final position of the bimetal device 4 when there is a change in temperature .DELTA.T being represented by dashed lines.

Figure 4:
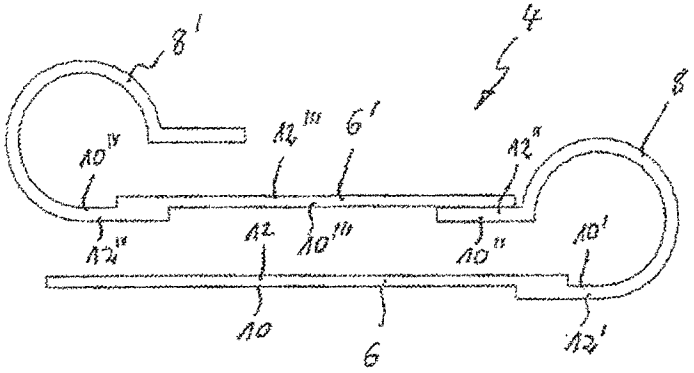
FIG. 4 shows a further embodiment of a bimetal device.

FIG. 4 shows a further embodiment of the bimetal device 4, here a plurality of first bimetal elements 6 and arcuate, second bimetal elements 8 being arranged alongside one another in series and here in particular in a meandering form. In this way, the switching travel 26 represented in FIG. 3 when there is a change in temperature .DELTA.T can be increased almost at will, allowing unwanted movements, here for example the drift to the right of the switching region 13 depicted in FIG. 3, to be corrected. The bimetal elements 6, 8 represented here in FIG. 4 also respectively have a layer structure, consisting of at least two element layers 10, 12, such as that which has already been explained at length with reference to FIG. 3.

Figure 6:
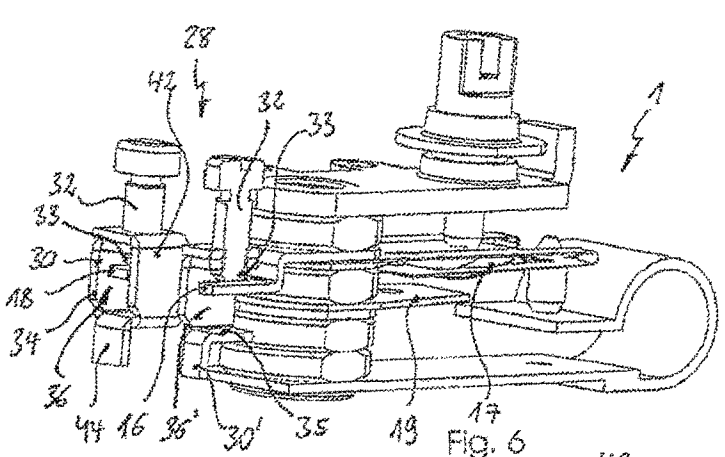
FIG. 6 shows an isometric longitudinal section of the representation from FIG. 5.
Figure 7:
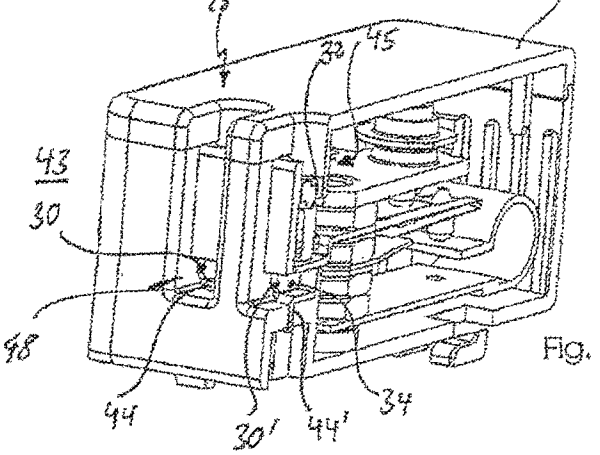
FIG. 7 shows an isometric longitudinal section of the embodiment of the bimetal controller according to FIG. 5 when integrated in a housing.
Figure 5:
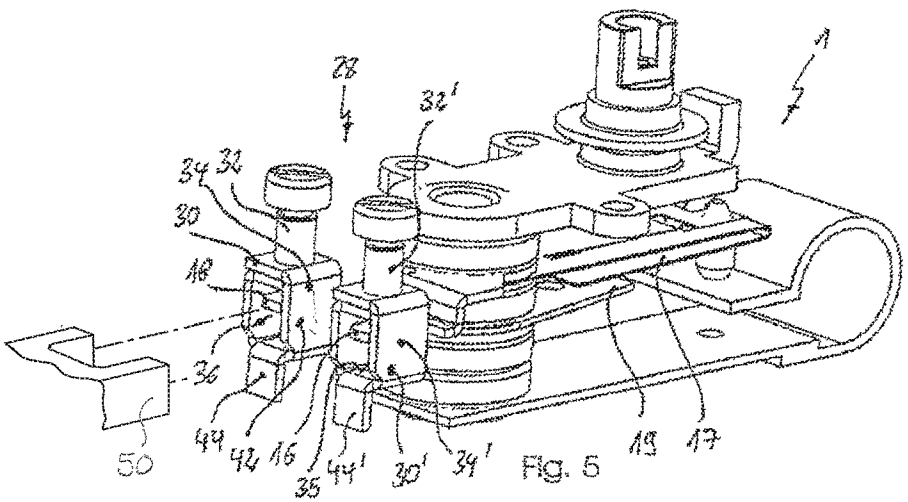
FIG. 5 shows an isometric representation of the embodiment of the bimetal controller according to FIG. 1 with paternoster connection terminals.

In FIGS. 5 to 7, the embodiment discussed above, according to FIGS. 1 to 3, is represented again in an isometric view (FIG. 5) and in a longitudinal section (FIG. 6). The embodiment of the bimetal controller 1 has been supplemented here by clamping devices 28, and in particular by two paternoster terminals 30, which allow easy connection of a conducting element 50 to the bimetal controller 1. If in the case of the prior art the contact elements 16, 18 have usually been connected to further conducting elements 50 by way of a soldered connection, here the connection of the bimetal controller 1 or of the contact elements 16, 18 takes place by way of the paternoster terminals 30. The advantage of this connecting technique is that no thermal energy is introduced into the contact elements 16 and 18, and by way of these into the switching contacts 17, 19, and in particular the switching contact 17 formed here as a beryllium-sprung spring, by a soldering or welding operation. This is so because it is specifically this introduction of heat that has led to deformations, and to a weakening of the restoring force of the switching contact 17 configured as a sprung-spring element, in the prior art. This artificial aging, which corresponded substantially to a thermal after-treatment, often led to a malfunction of the bimetal controllers 1.

In principle, it should be noted that the use of this clamping technique by means of the paternoster terminals 30 for the connection of a conducting element to the contact elements 16, 18 is not restricted only to use in the case of the bimetal controller 1 according to the invention that is represented here. All components provided with contact elements or switching contacts, in particular with heat-sensitive contact elements or switching contacts, can be equipped correspondingly.

The clamping devices 28 represented in FIGS. 5 to 7 for the electrically conducting connection of at least one conducting element 50 to at least one contact element 16, 18 of a switching device, and here of the bimetal controller 1, that is mounted in a housing 40 has the following:

A clamping bolt 32 and a clamping bolt receptacle 34, which together define a clamping space 36, into which the conducting element 50 can be introduced, in particular from an outer side 43 of the housing 40, and into which the contact element (16, 18) protrudes, in particular from an inner side 45 of the housing 40 (see FIG. 7 in particular), the clamping bolt 32 being held in its axial direction, in particular in the housing 40, and lying with a clamping continuation 33 against the contact element 16, 18 in an unconstrained manner, and a counter bearing region 35 of the clamping bolt receptacle 34 being able to be moved toward the clamping continuation 33 and the contact element 16, 18 lying on it while reducing the clamping space 36 and able to be fixed at least in one clamping position such that the conducting element 50 and the contact element 16, 18 are fixed with respect to each other in an electrically conducting manner, without a flexural loading being introduced into the contact element 16, 18. The clamping device 28 according to the invention or the paternoster terminal 30 therefore has not only the advantage of easy connection of a conducting element to the contact elements 16, 18, in particular without any introduction of heat, but also the advantage of an unconstrained connection, so that no flexural loadings are introduced into the contact elements 16, 18 and the assigned switching contacts 17, 19.

Preferably, the clamping bolt receptacle 34 is formed as a clamping bolt shoe, which at least partially encloses the clamping space 36, the counter bearing region 35 being formed on the inner bottom wall thereof, facing the clamping continuation 33. The clamping bolt receptacle 34 is in this case preferably mounted movably in the axial direction of the clamping bolt 32 on the clamping bolt. As represented here, the clamping bolt 32 is preferably provided with a threaded region, which is in threaded engagement with a thread receiving region of the clamping bolt receptacle 34 in such a way that the counter bearing region 35 of the clamping bolt receptacle 34 can be moved toward the contact element 16, 18 and away from it by a rotation of the clamping bolt 32 toward the clamping bolt continuation 33 and the contact element 16, 18 lying against it.

As can be seen in FIGS. 5 and 6, the clamping bolt receptacle 34 is preferably formed from a metal strip 42 folded over a number of times. This allows inexpensive production, with at the same time good stability and sufficient material for the forming of a thread receiving region.

The clamping bolt receptacle 34 preferably has on its lower bottom region a covering element 44, which serves during the connection of a conducting element as a guide for it. The covering element 44 in this case preferably extends axially parallel to the clamping bolt 32 in such a way that, when there is a reduction in the clamping space 36, that is to say brought about here by a rotation of the clamping bolt 32, it successively covers a receiving opening 48 in the housing 40. This prevents inappropriate introduction of the conducting element.

The invention claimed is:

1. A bimetal controller for temperature-dependent switching, the bimetal controller comprising:

a switching device; and a bimetal device connected to the switching device for switching the switching device responsive to a change in an ambient temperature, the bimetal device and the switching device being electrically isolated from each other, the bimetal device comprising a first bimetal element and a second bimetal element, the first bimetal element comprising an elongate shape, the second bimetal element comprising an arcuate shape;

the second bimetal element being attached solely to a free end of first bimetal element at a contact region, the first bimetal element comprising a first movement responsive to the change in the ambient temperature, the first movement being in a first direction the second bimetal element comprising a second movement responsive to the change in the ambient temperature, the second movement being in a second direction, the first direction and the second direction being a same direction, and the first movement and the second movement being additive to form a switching movement;

wherein in the contact region a coefficient of thermal expansion of the first bimetal element decreases from an underside of the first bimetal element to an upper side of the first bimetal element and a coefficient of thermal expansion of the second bimetal element increases from an underside of the second bimetal element to the upper side of the second bimetal element, or the coefficient of thermal expansion of the first bimetal element increases from the underside the first bimetal element to the upper side of the first bimetal element and the coefficient of thermal expansion of the second bimetal element decreases from the underside of the second bimetal element to the upper side of the second bimetal element.

2. The bimetal controller as claimed in claim 1, wherein each of the first bimetal element and the second bimetal element comprise a layer structure, each layer structure comprising a plurality of element layers, each element layer comprising a respective different coefficient of thermal expansion ($\alpha_{\Delta T10}$, $\alpha_{\Delta T12}$) than another element layer in the respective bimetal element, wherein the coefficients of thermal expansion ($\alpha_{\Delta T10}$, $\alpha_{\Delta T12}$) in the layer structure of the first bimetal element at the contact region progress oppositely to the coefficients of thermal expansion ($\alpha\Delta_{T10}$, $\alpha_{\Delta T12}$) in the layer structure of second bimetal element.

3. The bimetal controller as claimed in claim 1, wherein the first bimetal element or second bimetal element are formed as a bimetal strip.

4. The bimetal controller as claimed in claim 1, wherein the contact region is arranged at a distal end of the first bimetal element and a proximal end of the second bimetal element.

5. The bimetal controller as claimed in claim 1, wherein the second bimetal element comprises a substantially linearly formed switching region connected to the switching device, the switching region being disposed at a distal end of the arcuate shape.

6. The bimetal controller as claimed in claim 5, wherein the switching region comprises a principal axis, the arcuate shape comprises a tangent, wherein an angle defined by an intersection of the principal axis and the tangent is less than 180 degrees.

7. A connection apparatus for temperature-dependent switching, the apparatus comprising:

the bimetal controller of claim 1;

a housing for housing the bimetal controller;

a clamping bolt and a clamping bolt receptacle jointly defining a clamping space inside the housing;

a conducting element extending from an exterior of the housing into the clamping space;

a contact element protruding into the clamping space, wherein the clamping bolt being held in an axial direction of the clamping bolt in the housing and lying with a clamping continuation against the contact element in an unconstrained manner, wherein a counter bearing region of the clamping bolt receptacle is moveable toward the clamping continuation and the contact element lying on the clamping bolt while reducing the clamping space and immovable at least in one clamping position such that the conducting element and the contact element are fixed with respect to each other in an electrically conducting manner, without a flexural loading being introduced into the contact element.

8. The bimetal controller as claimed in claim 1, wherein the first bimetal element and the second bimetal element are arranged in series in a meandering series.

9. A bimetal controller for temperature-dependent switching of a switching device, the bimetal controller comprising:

a switching element actuating the switching device; and a first bimetal element and a second bimetal element, the second bimetal element having a proximal end and a distal end, the distal end being unsupported, the proximal end being attached only to a free end, the proximal end and the free end defining a contact region, the first bimetal element comprising an elongate shape, the second bimetal element comprising an arcuate shape disposed between the proximal end and the distal end;

wherein, responsive to a change in an ambient temperature, the first bimetal element comprises a first movement in a first direction and the second bimetal element comprises a second movement in a second direction, the first direction and the second direction being a same direction, and the first movement and the second movement being additive to displace the distal end to move the switching element in order to actuate the switching device;

wherein, in the contact region, a coefficient of thermal expansion of the first bimetal element decreases from an underside of the first bimetal element to an upper side of the first bimetal element and a coefficient of thermal expansion of the second bimetal element increases from an underside of the second bimetal element to the upper side of the second bimetal element, or the coefficient of thermal expansion of the first bimetal element increases from the underside the first bimetal element to the upper side of the first bimetal element and the coefficient of thermal expansion of the second bimetal element decreases from the underside of the second bimetal element to the upper side of the second bimetal element;

wherein the first bimetal element and the second bimetal element are electrically isolated from the switching element.

10. The bimetal controller as claimed in claim 9, wherein each of the first bimetal element and the second bimetal element comprises a layer structure, each layer structure comprising a plurality of element layers, each element layer comprising a respective different coefficient of thermal expansion ($\alpha_{\Delta T10}$, $\alpha_{\Delta T12}$) than another element layer in the respective bimetal element, wherein the coefficients of thermal expansion ($\alpha_{\Delta T10}$, $\alpha_{\Delta T12}$) in the layer structure of the first bimetal element at the contact region progress oppositely to the coefficients of thermal expansion ($\alpha_{\Delta T10}$, $\alpha_{\Delta T12}$) in the layer structure of second bimetal element.

11. The bimetal controller as claimed in claim 9, wherein the first bimetal element or second bimetal element are formed as a bimetal strip.

12. The bimetal controller as claimed in claim 9, wherein the contact region is arranged at a distal end of the first bimetal element and the proximal end of the second bimetal element.

13. The bimetal controller as claimed in claim 9, wherein the distal end is substantially linear and is disposed in contact with the switching element.

14. The bimetal controller as claimed in claim 13, wherein the distal end comprises a principal axis, the arcuate shape comprises a tangent, wherein an angle defined by an intersection of the principal axis and the tangent is less than 180 degrees.

* * * * *